US005619824A

United States Patent [19]

Russell et al.

[11] Patent Number: 5,619,824

[45] Date of Patent: Apr. 15, 1997

[54] HEAT RELEASEABLE CEILING SUPPORT

[75] Inventors: Scott H. Russell, Kalamazoo; Mark A. Baloga, East Grand Rapids; David P. Lathrop, Ada, all of Mich.; Kevin S. Nason, Racine, Wis.; Paul B. Siebert, East Grand Rapids, Mich.

[73] Assignee: Steelcase, Inc., Grand Rapids, Mich.

[21] Appl. No.: 489,656

[22] Filed: Jun. 12, 1995

[51] Int. Cl.[6] ..... E04H 1/12

[52] U.S. Cl. ..... 52/1; 52/323; 52/239; 248/550; 248/901

[58] Field of Search ..... 52/1, 232, 239; 248/550, 548, 901, 247, 248, 224.8; 403/28; 49/7, 8; 292/DIG. 66

[56] References Cited

U.S. PATENT DOCUMENTS

| | | | |
|---|---|---|---|
| 1,017,715 | 2/1912 | Voigtmann | 49/7 |
| 2,580,540 | 1/1952 | Graves . | |
| 2,718,290 | 9/1955 | Segil . | |
| 2,772,742 | 12/1956 | Sprankle . | |
| 2,800,965 | 7/1957 | Church . | |
| 3,062,298 | 11/1962 | Nash . | |
| 3,246,432 | 4/1966 | Young, Jr. . | |
| 3,654,996 | 4/1972 | Naglowsky . | |
| 4,013,253 | 3/1977 | Perrault et al. | 248/248 |
| 4,245,446 | 1/1981 | Judkins . | |
| 4,437,693 | 3/1984 | Godec | 49/8 |
| 4,856,242 | 8/1989 | Baloga et al. | 52/239 |
| 5,155,955 | 10/1992 | Ball et al. | 52/239 X |
| 5,282,341 | 2/1994 | Baloga et al. . | |

*Primary Examiner*—Carl D. Friedman
*Assistant Examiner*—Timothy B. Kang
*Attorney, Agent, or Firm*—Price, Heneveld, Cooper, DeWitt & Litton

[57] ABSTRACT

A heat releasable bracket, for supporting a ceiling panel under normal conditions, and for releasing the ceiling panel when exposed to elevated temperatures caused by a nearby fire or the like, includes a first bracket part which includes a mounting portion for securing the first bracket portion to a support structure such as a beam, column, wall, etc.; a second bracket part which is adapted to be secured to the first bracket part and provide a support for the ceiling panel; and a heat releasable link which normally joins the first and second bracket parts together, but which releases the second bracket part from the first bracket part when exposed to elevated temperatures, which in turn allows the ceiling panel to drop away from the position at which it is normally supported. The heat releasable bracket can form part of an effective and relatively inexpensive ceiling panel support system comprised of at least one heat releasable bracket and at least one other bracket which is not heat releasable. The invention is useful for normally supporting a ceiling panel, but releasing it if a fire occurs so that it does not interfere with effective utilization of a sprinkler system located above the ceiling panel.

35 Claims, 1 Drawing Sheet

HEAT RELEASEABLE CEILING SUPPORT

BACKGROUND OF THE INVENTION

This invention relates to a heat releasable bracket which allows a ceiling panel to drop from an overhead position at which it is normally supported, in the event of a fire or the like, to expose the area normally below the ceiling panel to an overhead sprinkler system, whereby the ceiling panel is eliminated as an impediment to effective sprinkler utilization. More specifically, the invention relates to a heat releasable bracket which is adapted for supporting a ceiling panel or overhead acoustic baffle at the upper end of a portable workspace module to provide enhanced privacy therein and to abate external noises, while allowing the workspace modules to be repositioned as desired within an open plan office space generally without regard to the position of overhead sprinkler nozzles. The invention also relates to ceiling panel support systems utilizing a heat releasable bracket, and to workspace modules wherein a heat releasable bracket is used to support an overhead ceiling panel or acoustical baffle.

Workspace modules which provide a personal office space within a larger, open room in a building have recently been developed for use in a variety of business offices wherein flexibility and adaptability of the available office space is valued. One example of a portable, freestanding type of workspace module is disclosed in commonly assigned U.S. Pat. No. 5,282,341. Such workspace modules are particularly useful for businesses which regularly organize project teams which are to solve a particular problem or perform a particular set of tasks, and which are to be reorganized or disbanded within a relatively short period of time. The portable workspace modules provide team members with private office space which can be used to perform independent work activities more efficiently than would be possible within an open, shared office space. As the project assigned to the team progresses, it is often desirable and advantageous to reorganize the office space. For example, it may be useful to add or remove private workspaces, add or remove group workspaces, convert group workspace to private work space, convert private workspace to group work space, or modify the way private workspace is positionally organized around group work spaces. The portable, freestanding workspace modules facilitate fast, easy, inexpensive reorganization of office space, e.g., redistribution of private workspace within an open office area.

In order to achieve enhanced privacy and to reduce distraction caused by noises originating outside the portable, freestanding workspace module, and thereby provide a private work environment more conducive to achieving efficient independent work, it is generally desirable to provide an overhead acoustic damping ceiling baffle or panel which closes off a substantial portion of the opening at the upper end of the workspace module. Most local building codes or other applicable regulations require an overhead sprinkler system to conform to the requirements of NFPA 13. The intent of these requirements is to insure that no portion of the space is obstructed from sprinkler flow, so that the entire space is protected by the sprinkler system. The details of said regulations comprise a complex and arcane series of restrictions on the height, size, and location of obstructions relative to the sprinkler heads. Depending on the height of the ceiling (and sprinkler heads), sprinkler type, and original classification of the space, the space may be reclassified if tall workstation modules with ceiling partitions are located therein. Such workstations may not be permitted in some jurisdictions for certain occupancy groups. In some cases, it may be necessary to remove the ceiling tiles, and carefully plan the layout of the workstations so as to have exact relations between the workstations and the sprinkling system in order to qualify. Alternatively, it may be possible to lay out the desired workstation arrangement, and then have the fire system engineering contractor modify the layout, rebuild, and re-qualify the sprinkler system for the new furniture arrangement.

Removing ceiling panels may help in some situations, but is undesirable because of the sacrifice of acoustic privacy and the loss of the sense of spacial enclosure. Carefully positioning the workspace modules under sprinkler nozzles to comply with fire safety requirements is very difficult, and significantly frustrates and negates a major purpose and one of the primary advantages of the workspace module, which is to allow complete freedom in the organization and utilization of the office area to promote efficient teamwork. Repositioning of sprinkler nozzles would be expensive and disruptive to the work environment.

There is, therefore, a need for a portable workspace module which has an overhead ceiling panel, and which can be positioned generally anywhere within a room of a building having a conventional overhead sprinkler system, without regard to the position of overhead sprinkler nozzles, and while complying with all applicable fire safety requirements.

SUMMARY OF THE INVENTION

The invention provides a heat releasable bracket which can be used to support an overhead panel or baffle and which will release the same should a fire occur in the immediate vicinity thereof. The heat releasable bracket of the invention is especially useful for supporting a ceiling panel or baffle at the upper end of a portable workspace module and releasing the panel or baffle if the temperature surrounding the heat releasable bracket reaches a predetermined elevated temperature. In particular, by using a heat releasable bracket which will allow the ceiling panel or baffle to drop from the upper end of the workspace module if the surrounding temperature approaches or reaches the temperature at which a conventional overhead sprinkler system is activated, it is possible to arbitrarily position the workspace module in a room having a conventional overhead sprinkler system, and comply with any applicable fire safety requirements.

In accordance with one aspect of the invention, a heat releasable bracket is provided which has a first bracket part which is securable to a support structure, and a second bracket part which is attached to the first bracket part by a heat releasable link. The second bracket part includes a surface onto which a ceiling panel or baffle can be supported. The heat releasable link can generally be any linking device which can be used to hold the second bracket part in a fixed relationship with the first bracket part so that the ceiling panel or baffle is stablely supported on the bracket under ordinary conditions, and will release the second bracket part supporting the ceiling panel or baffle, if the temperature exceeds a predetermined level.

The present invention also provides a heat releasable ceiling panel support system for retaining a ceiling panel or baffle at the upper end of a workspace module under normal conditions, but which will allow the ceiling panel to drop from the upper end of the workspace module should the surrounding temperature exceed a predetermined level. The system includes at least one heat releasable bracket which will support the ceiling panel or baffle under normal conditions, and will allow it to drop at a predetermined elevated temperature; at least one passive bracket which will cooperate with the heat releasable bracket to support the ceiling panel or baffle under normal conditions, but which is generally unsuitable for support of the ceiling panel or baffle without cooperative support from the heat releasable bracket; and, optionally, at least one hold-down bracket which prevents the ceiling panel or baffle from tipping off of the other brackets and falling therefrom.

A further aspect of the invention provides a freestanding workspace module with a heat releasable ceiling panel or baffle. The workspace module includes a framework to which walls and a door partition are supported. The module also includes a ceiling panel or baffle which is supported at the upper end of the workspace module by a plurality of brackets, at least one of which is a heat releasable bracket. The heat releasable bracket normally provides support for the ceiling panel under normal conditions, and will respond to a predetermined elevated temperature by releasing the ceiling panel or baffle and allowing it to fall from the upper end of the workspace module.

The invention provides a relatively simple, inexpensive and reliable bracket which can be advantageously employed to support a ceiling panel or baffle in an overhead position beneath a sprinkler system under normal conditions, but which will dependably release the ceiling panel or baffle if the surrounding temperature reaches a predetermined level, such as on account of a fire occurring in the immediate vicinity of the bracket. The bracket, thus, eliminates the ceiling panel or baffle as an obstruction, to allow effective utilization of the overhead sprinkler system. The invention is especially useful for heat releasably supporting a ceiling panel or baffle at the upper end of a freestanding workspace module, to freely take advantage of the portability and adaptability of the workspace module to meet changing needs in work area utilization to accommodate dynamic work groups or teams, without sacrificing privacy and without compromising on fire safety.

These and other features, objects, and benefits of the invention will be recognized by those who practice the invention and by those skilled in the art, from the specification, the claims, and the drawing figures.

DESCRIPTION OF THE PREFERRED EMBODIMENTS

Figures 1, 2, 3:
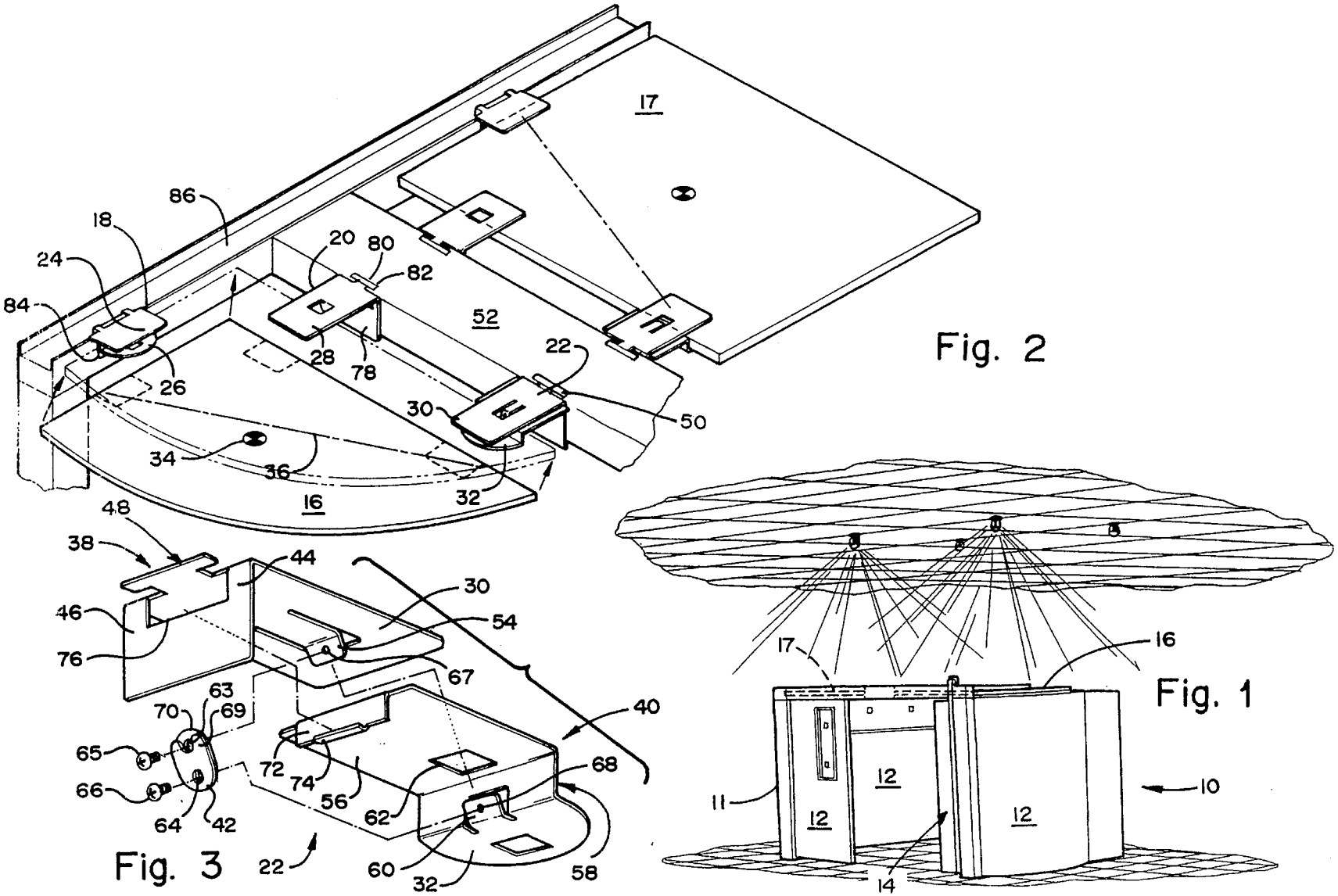
FIG. 1 is a perspective view of a workspace module employing a heat releasable bracket support system including a heat releasable bracket in accordance with a preferred embodiment of the invention.
FIG. 2 is an enlarged, fragmentary perspective view of the top portion of the workspace module shown in FIG. 1, showing in greater detail how the ceiling panels are supported at the upper end of the workspace module by a plurality of brackets.
FIG. 3 is an exploded perspective view showing the disassembled components of a heat releasable bracket in accordance with the invention.

Referring to the drawings, and in particular to FIG. 1, there is shown a portable workspace module 10 of the type which is freestanding and sufficiently rigid to be moved freely about a floor area underneath an overhead sprinkler system. The module 10 is used, especially in conjunction with a plurality of similar modules, to provide an efficient work environment in an open floor space of a building, wherein workers involved in team or group projects can alternate between group work activities in large open areas and individual work activities which are most efficiently conducted in private workspace insulated from external stimuli and distractions. Specific examples of workspace modules in which the invention can be advantageously used are disclosed in U.S. Pat. No. 5,282,341 the teachings of which are hereby incorporated by reference herein. The workspace module 10, which provides an architectural subdivision within an architectural space, includes a freestanding framework 11, walls 12 supported on the framework, and a door partition 14 which can be closed to provide an enclosed personal workspace. Included at the upper portion of the workspace module 10 are ceiling panels or baffles 16, 17 supported from beams 52, 86 of the freestanding framework. The ceiling panels or baffles 16, 17 partially enclose the otherwise open top end of the workspace module 10 to provide an enhanced sense of privacy and to reduce and dampen external noises, so that the worker occupying the workspace module enjoys an improved sensation of isolation which, in turn, results in greater productivity and work efficiency.

In FIG. 2, there are shown heat releasable ceiling baffle, or panel, support systems which are comprised of a plurality of brackets 18, 20, and 22 which securely retain ceiling baffles 16, 17, which may be acoustical baffles, suspended at the upper end of the workspace module 10 under normal conditions, but which release the panels 16, 17 and allow them to fall freely away from the upper end of the workspace module when they are exposed to an elevated temperature such as would exist in the immediate vicinity of an open flame or smoldering fire. In particular, the heat releasable ceiling baffle support system is designed to release baffles 16, 17 under the same conditions which would exist immediately before an overhead sprinkler system is activated. The heat releasable ceiling baffle support system allows the overhead sprinkler system to control a fire in the room of a building in which the workspace module 10 is located and to abate fire damage, unimpeded by the ceiling panels or baffles.

In accordance with a preferred aspect of the invention, the heat releasable ceiling baffle support system is comprised of a plurality of brackets which do not normally respond to elevated temperatures, i.e., passive brackets 18, 20; and at least one active heat releasable bracket 22 which does respond to an elevated temperature. More specifically, a particularly desirable heat releasable ceiling baffle support system for use with a portable, freestanding workspace module 10 comprises a passive bracket 18 having an upper flange portion 24 and a lower horizontal flange portion 26 having a surface for engaging and supporting a ceiling panel or baffle; a passive hold-down bracket 20 having a single horizontal flange portion 28; and an active heat releasable bracket 22 having upper and lower horizontal flange portions 30 and 32 respectively. Referring to FIG. 2, brackets 18, 20, 22 are strategically positioned about the perimeter of circle segment shaped ceiling baffle 16 such that the center of mass, indicated by mark 34, and the hold-down bracket 20 are on opposite sides of a straight line, indicated by dashed line 36, between passive bracket 18 and active bracket 22 so that the ceiling panel or baffle is supported from its underside by support surfaces on lower flange portions 26 and 32 of brackets 18 and 22 respectively, and a surface of flange portion 28 of bracket 20 bears against the upper surface of baffle 16 to prevent it from twisting about line 36 because of the imbalance caused by the displacement of the center of mass from line 36. Brackets 18 and 22 are desirably positioned as far apart as possible, while still meeting the above stated criterion regarding bracket positioning with respect to the center of mass of the baffle 16. This will generally provide optimum balancing of the forces on the brackets 18, 20, 22 to provide a stable load distribution, wherein the panel or baffle is securely retained at the desired location at the upper end of a workspace module 10 using a minimum number of brackets. The above criteria regarding bracket placement is broadly applicable to a variety of regular and irregular shaped ceiling baffles, and is not in any way limited to the circle segment shaped baffle 16 or rectangular shaped baffle 17 shown in FIG. 2. While the baffles 16, 17 can be supported from the beams 52, 86 or framework using a support system comprised exclusively of a plurality of heat releasable brackets 22 which respond to an elevated temperature, it is generally desirable to use relatively inexpensive passive brackets 18, 20 which when used, as described herein, in combination with an active heat releasable bracket 22 provide an equally effective system, which may even be somewhat more reliable, because effective operation of the system, in the event of a fire, relies on a single fusible link, described hereinafter. The baffle support system is designed to release baffles 16, 17 in a predictable, controlled manner in the event of a fire. More specifically, when baffles 16, 17 are released by heat releasable brackets 22, baffles 16, 17 swing downwardly about an axis generally parallel to, and near to, the edge of the baffles supported by passive brackets 18.

Details regarding the heat releasable bracket 22 are illustrated in FIG. 3, which shows the components thereof in a disassembled state. Bracket 22 includes an upper bracket part 38 which is adapted to be mounted onto a support structure such as a wall, beam, column, etc., and a lower bracket part 40 which is supported from the upper bracket by a heat fusible link 42. The upper bracket part 38 has a flange portion 30 which projects horizontally away from a support structure to which bracket part 38 is mounted. The upper bracket part 38 also includes a mounting portion 44 through which part 38 is secured to a supporting structure. The mounting portion can be comprised of generally any suitable device or means for facilitating attachment of the upper bracket part 38 to a wall, beam, column, or other support structure. The mounting portion, for example, can be comprised of any of various clips, tabs, hooks, etc. The mounting portion can also, for example, be comprised merely of a surface area of the flange portion 30 which is used to adhesively bond the upper bracket part 38 to a support structure or through which a fastener such as a nail or screw is passed to secure part 38 to a support structure. In accordance with the illustrated embodiment shown in FIG. 3, mounting portion 44 is comprised of a vertical flange portion 46 which extends from a rearward end (opposite the outwardly projecting or forward end) of flange portion 30; and a tab 48 which projects rearwardly from flange portion 30, past flange portion 46. Tab 48 is adapted to be received within a narrow slot 50 (FIGS. 2 and 3) provided in a horizontal upper surface of a support structure, which in the illustrated embodiment is transverse beam 52 which constitutes part of the structural framework of workspace module 10. Upper bracket part 38 also includes a coupling tab 54 which slants downwardly and forwardly from a central location on horizontal flange portion 30. Lower bracket part 40 is a member having a flange plate 56 the top surface of which abuts the underside of flange portion 30 when bracket 22 is assembled, a lower horizontal flange portion 32 for supporting a ceiling panel or baffle such as baffle 16 or 17, and a vertical step portion 58 connecting flange plate 56 with horizontal flange portion 32. Lower bracket part 40 also includes a coupling tab 60 which slants upwardly and rearwardly from a central location generally at the intersection between the lower horizontal flange portion 32 and vertical step portion 58. Downwardly slanting coupling tab 54 projects through an opening 62 in flange plate 56 of lower bracket part 40 and is adjacent to and in planar alignment with upwardly slanting coupling tab 60 when bracket 22 is assembled. Bracket parts 38 and 40 are held together by a single heat fusible link assembly 42 having fastener openings 63, 64. Fasteners 65, 66 pass through respective openings 63, 64 in fusible link 42 and are securely received within corresponding openings 67, 68 in coupling tabs 54 and 60 respectively to secure bracket parts 38 and 40 to each other. The illustrated heat releasable link 42 is comprised of a pair of overlapping metal plates 69, 70 which are joined together by a heat fusible metal alloy, such as tin-antimony solder, having a desired low melting point temperature. More specifically, the heat fusible metal alloy should have a melting point temperature which is high enough to avoid decoupling of plates 69, 70 and release of ceiling baffles supported by bracket 22 at temperatures which can be reached on the hottest days, and sufficiently low to allow decoupling of plates 69, 70 should a fire occur in the vicinity of bracket 22. Most preferably, the heat fusible metal should have a melting point temperature slightly lower than the temperature at which an overhead sprinkler system is activated. Suitable heat fusible links which are substantially identical with the illustrated link 42 are commercially available. Various other known heat responsive links can be used in place of the illustrated link 42 without departing from the principles of the invention. For example, a heat responsive link comprised of a low boiling point liquid contained in a sealed rupturable, disintegratable vial are commercially available and can be employed successfully in the invention. In this case, separation of bracket parts 38 and 40 and release of the supported ceiling baffles occurs when the low boiling point liquid is volatilized causing a glass vial, containing the low boiling point material and connected at opposing ends to parts 38 and 40, to rupture and disintegrate due to the build up of pressure in the vial. Various other suitable heat releasable links are also commercially available.

The lower bracket part 40 also preferably includes a flap 72 which extends downwardly from the rearward end (end closest to the support structure to which the upper bracket part 38 is mounted) of flange plate 56 and has at its lower end a rearwardly extending swing tab 74 which is adapted to be received in a rectangular slot 76 in flange portion 46 of upper bracket part 38, so that lower bracket part 40 can swing downwardly about a pivot axis approximately coincident with tab 74 and slot 76 when parts 38 and 40 are decoupled by exposure of link 42 to an elevated temperature. This controls the direction of forces on fusible link 42 and helps to ensure that lower bracket part 40 will swing out of the way allowing baffles 16, 17 to fall freely from the framework of workspace module 10 should a fire occur in the vicinity of the bracket 22.

The passive hold-down bracket 20, which is used in combination with passive bracket 18 and heat releasable bracket 22 as part of a heat releasable ceiling baffle support system, is a generally L-shaped member having a horizontal flange portion 28 the underside of which engages the top of a baffle 16, 17 to hold the baffle down, and a mounting portion which can be comprised of any suitable device or means for facilitating attachment of the hold-down bracket 20 to a support structure, such as a mounting portion generally similar to that of the heat releasable bracket 22. The mounting portion of the illustrated hold-down bracket is substantially identical to that of the illustrated heat releasable bracket 22, and includes a vertical flange portion 78 which extends from a rearward end of horizontal flange portion 28; and a tab 80 which projects rearwardly from flange portion 28, past flange portion 78. Tab 80 is adapted to be received within a narrow slot 82 in the horizontal upper surfaces of transverse beam 52.

Passive support bracket 18 includes, in addition to upper end lower flange portions 24 and 26, a mounting portion which can be comprised of any suitable device or means for facilitating attachment of the bracket 18 to a support structure. The mounting portion of the illustrated passive support bracket 18 is comprised of an inverted U-shaped clip having a forward vertical flange plate 84 from which horizontal flange portions 24 and 26 project forwardly and a pair of rearward horizontal flange plates (not shown). Bracket 18 is secured to longitudinal beam 86, such as by wedging an upstanding web of beam 86 between forward flange plate 84 and rearward the rearward vertical flange plate (not shown). The upstanding web of beam 86 can be provided with a notched-out area to indicate proper positioning of bracket 18. Bracket 18 is specially designed to cooperate with bracket 22 to support the weight of a ceiling baffle 16, 17, while being incapable of independently supporting the ceiling baffle 16 or 17 without the assistance of bracket 22. For example, the baffles 16, 17 can be designed to deflect downwardly when support from heat releasable bracket 22 is removed, and slide outwardly away from passive bracket 18. Alternatively, the lower flange portion 26 can be made of a suitable thickness and from a suitable material which will not deflect downwardly when the weight of the baffle 16 or 17 is distributed between bracket 18 and 22, but which will deflect downwardly when bracket 22 is not supporting part of the weight of baffle 16 or 17. As another alternative, upper flange portion 26 can be eliminated or made of suitable thickness and of a suitable material which will allow it to deflect upwardly under the forces imposed on it by the weight of the ceiling panel 16 or 17 when bracket 22 does not support the panel.

Mounting of the baffles 16 and 17 onto workspace module 10 is achieved by securing the brackets 18, 20, 22 to the framework of the workspace module in a manner consistent with the foregoing description and accompanying drawings, and sliding the baffles 18, between flange portions 30, 32 of bracket 22, and beneath flange portion 28 of bracket 20. Flange portions 24 and 26, and flange portions 30 and 32, are preferably suitably spaced apart so that the ceiling baffles 16, 17 are wedged therebetween, so that ceiling baffles 16, 17 are not merely loosely supported by lower flanges 24 and 30, but are retained between flange portions 24 and 26, and 30 and 32.

The brackets 18, 20, 22 can be fabricated from a variety of suitable materials, such as from aluminum, steel, or stainless steel sheet metal or from a thermoplastic or thermoset material.

While the heat releasable bracket and ceiling panel support system of the invention are particularly well adapted for use with portable workspace modules, the brackets and support systems would also be useful in non-portable, non-freestanding environments as well.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A heat releasable bracket for use in supporting a panel at an upper end of a freestanding workspace module, comprising:

a first bracket part adapted to be mounted on a support structure;

a second bracket part adapted to be joined to said first bracket part, said second bracket part having a surface for supportingly engaging the panel; and a heat releasable link which at a normal room temperature joins said second bracket part to said first bracket part, and which in response to exposure to an elevated temperature releases said second bracket part from said first bracket part, allowing the panel to drop from the support structure;

said first bracket part including a mounting portion for attachment thereof to a support structure, said mounting portion comprising a vertical flange portion attached at a right angle to a horizontal projecting flange portion, one of said flange portions having a tab adapted to engage a slot provided in the support structure to secure said first bracket thereto.

2. The bracket of claim 1, wherein said first bracket part includes a horizontal projecting flange portion having a downwardly slanting coupling tab, and said second bracket part includes an upwardly slanting coupling tab, said downwardly and upwardly slanting coupling tabs being adjacent to and in planar alignment with each other when said bracket is assembled, said tabs being joined together through said heat releasable link.

3. The bracket of claim 2, wherein said second bracket part is a member which includes a flange plate having a top surface which abuts the underside of said horizontally projecting flange portion of said first bracket part, and having an opening through which said downwardly slanting tab passes;

a lower horizontal flange having an upper surface for supportingly engaging the panel; and a vertical step connecting said flange plate and said flange of said second bracket part.

4. The bracket of claim 3, wherein said second bracket part includes a flap which extends downwardly from the end of said flange plate nearest said mounting portion of said first bracket part, said flap having a swing tab which projects outwardly away from said flange plate, said swing tab being received in a rectangular slot in the vertical flange portion of said first bracket part to allow said second bracket part to swing downwardly about a pivot axis approximately coincident with said slot when said heat releasable link is exposed to an elevated temperature which allows said second bracket part to be released from said first bracket part.

5. The bracket of claim 1, wherein said heat releasable link is comprised of a pair of overlapped metal plates joined together by a heat fusible metal alloy which melts at an elevated temperature to allow the plates to decouple in the event of a fire, which can allow a panel supported by said bracket to drop from the support structure.

6. A heat releasable panel support system for retaining a panel at an upper end of a freestanding workspace module, comprising:

a support structure;

a passive bracket mounted on said support structure, said passive bracket having a surface supportingly engaging the underside of the panel; and a heat releasable bracket including a first bracket part mounted on said support structure, a second bracket part joined to said first bracket part, said second bracket part having a surface supportingly engaging the underside of the panel, and a heat releasable link which at a normal room temperature joins said second bracket part to said first bracket part, and which in response to being exposed to an elevated temperature will release said second bracket part from said first bracket part, allowing the panel to drop from the support structure.

7. The system of claim 6, wherein said passive bracket includes lower and upper horizontal flanges adapted to provide support for and securely retain a panel positioned between said horizontal flanges.

8. The system of claim 6, wherein said passive bracket is adapted to cooperate with at least one other bracket to support the panel, and said passive bracket is unable to independently support the panel.

9. The system of claim 6, wherein said first bracket part includes a mounting portion for attachment thereof to a support structure.

10. The system of claim 9, wherein said mounting portion comprises a vertical flange portion attached at a right angle to a horizontal projecting flange portion, one of said flange portions having a tab adapted to engage a slot provided in the support structure to secure said first bracket thereto.

11. The system of claim 10, wherein said first bracket part includes a horizontal projecting flange portion having a downwardly slanting coupling tab, and said second bracket includes an upwardly slanting coupling tab, said downwardly and upwardly slanting coupling tabs being adjacent to and in planar alignment with each other when said bracket is assembled, said tabs being joined together through said heat releasable link.

12. The system of claim 11, wherein said second bracket part is a member which includes a flange plate having a top surface which abuts the underside of said horizontally projecting flange portion of said first bracket part, and having an opening through which said downwardly slanting tab passes;

a lower horizontal flange having an upper surface for supportingly engaging the panel; and a vertical step connecting said flange plate and said flange of said second bracket part.

13. The system of claim 12, wherein said second bracket part includes a flap which extends downwardly from the end of said flange plate nearest said mounting portion of said first bracket, said flap having a swing tab which projects outwardly away from said flange plate, said swing tab being received in a rectangular slot in the vertical flange portion of said first bracket part to allow said second bracket part to swing downwardly about a pivot axis approximately coincident with said slot when said heat releasable link is exposed to an elevated temperature which can allow said second bracket part to be released from said first bracket part.

14. The system of claim 6, wherein said heat releasable link is comprised of a pair of overlapped metal plates joined together by a heat fusible metal alloy which melts at an elevated temperature to allow the plates to decouple in the event of a fire, which can allow a panel supported by said bracket to drop from the support structure.

15. A freestanding workspace module capable of providing an architectural subdivision within an architectural space, comprising:

a freestanding framework;

walls supported on the framework;

a door partition which can be closed to provide a personal workspace; and at least one panel partially enclosing an upper end of the workspace module, said panel being supported at the upper end of the workspace module by a heat releasable panel support system including at least one heat releasable bracket which at a normal room temperature provides support for said panel, and which, when exposed to an elevated temperature, will release said panel allowing it to drop from the upper end of the workspace module.

16. The workspace module of claim 15, wherein said heat releasable bracket includes a first bracket part mounted on a support structure;

a second bracket part joined to said first bracket part, said second bracket part having a surface supportingly engaging the panel; and a heat releasable link which at a normal room temperature joins said second bracket part to said first bracket part, and which in response to exposure to an elevated temperature releases said second bracket part from said first bracket part, allowing the panel to drop from the support structure.

17. The workspace module of claim 16, wherein said first bracket part includes a mounting portion for attachment thereof to a support structure.

18. The workspace module of claim 16, wherein said mounting portion comprises a vertical flange portion attached at a right angle to a horizontal projecting flange portion, one of said flange portions having a tab adapted to engage a slot provided in the support structure to secure said first bracket thereto.

19. The workspace module of claim 18, wherein said first bracket part includes a horizontal projecting flange portion having a downwardly slanting coupling tab, and said second bracket includes an upwardly slanting coupling tab, said downwardly and upwardly slanting coupling tabs being adjacent to and in planar alignment with each other when said bracket is assembled, said tabs being joined together through said heat releasable link.

20. The workspace module of claim 19, wherein said second bracket part is a member which includes a flange plate having a top surface which abuts the underside of said horizontally projecting flange portion of said first bracket part, and having an opening through which said downwardly slanting tab passes;

a lower horizontal flange having an upper surface for supportingly engaging the panel; and a vertical step connecting said flange plate and said flange of said second bracket part.

21. The workspace module of claim 20, wherein said second bracket part includes a flap which extends downwardly from the end of said flange plate nearest said mounting portion of said first bracket, said flap having a swing tab which projects outwardly away from said flange plate, said swing tab being received in a rectangular slot in the vertical flange portion of said first bracket part to allow said second bracket part to swing downwardly about a pivot axis approximately coincident with said slot when said heat releasable link is exposed to an elevated temperature which can allow said second bracket part to be released from said first bracket part.

22. A workspace comprising:

sidewalls arranged to define a workspace having a portal opening for user ingress and egress therethrough; and at least one panel partially enclosing an upper portion of the workspace, said panel being supported from an upper portion of the sidewalls by a heat releasable panel support system including at least one heat releasable bracket which at a normal room temperature provides support for said panel, and which, when exposed to an elevated temperature, will release said panel allowing it to drop from the upper portion of the workspace module.

23. The workspace of claim 22, wherein said sidewalls are freestanding and sufficiently rigid to be moved about a floor area underneath an overhead sprinkler system.

24. The workspace of claim 23, wherein said heat releasable bracket includes a first bracket part mounted on said sidewalls;

a second bracket part joined to said first bracket part, said second bracket part having a surface supportingly engaging the panel; and a heat releasable link which at a normal room temperature joins said second bracket part to said first bracket part, and which in response to exposure to an elevated temperature releases said second bracket part from said first bracket part, allowing the panel to drop from the support structure.

25. The workspace of claim 24, wherein said first bracket part includes a mounting portion for attachment thereof to a support structure.

26. The workspace of claim 25, wherein said mounting portion comprises a vertical flange portion attached at a right angle to a horizontal projecting flange portion, one of said flange portions having a tab adapted to engage a slot provided in said sidewalls to secure said first bracket thereto.

27. The workspace of claim 26, wherein said first bracket part includes a horizontal projecting flange portion having a downwardly slanting coupling tab, and said second bracket includes an upwardly slanting coupling tab, said downwardly and upwardly slanting coupling tabs being adjacent to and in planar alignment with each other when said bracket is assembled, said tabs being joined together through said heat releasable link.

28. The workspace of claim 27, wherein said second bracket part is a member which includes a flange plate having a top surface which abuts the underside of said horizontally projecting flange portion of said first bracket part, and having an opening through which said downwardly slanting tab passes;

a lower horizontal flange having an upper surface for supportingly engaging the panel; and a vertical step connecting said flange plate and said flange of said second bracket part.

29. The workspace of claim 28, wherein said second bracket part includes a flap which extends downwardly from the end of said flange plate nearest said mounting portion of said first bracket, said flap having a swing tab which projects outwardly away from said flange plate, said swing tab being received in a rectangular slot in the vertical flange portion of said first bracket part to allow said second bracket part to swing downwardly about a pivot axis approximately coincident with said slot when said heat releasable link is exposed to an elevated temperature which allows said second bracket part to be released from said first bracket part.

30. A heat releasable bracket for use in supporting a panel at an upper end of a freestanding workspace module, comprising:

a first bracket part adapted to be mounted on a support structure;

a second bracket part adapted to be joined to said first bracket part, said second bracket part having a surface for supportingly engaging the panel; and a heat releasable link which at a normal room temperature joins said second bracket part to said first bracket part, and which in response to exposure to an elevated temperature releases said second bracket part from said first bracket part, allowing the panel to drop from the support structure;

said second bracket part pivotally engaging said first bracket part when said heat fusible link releases said second bracket part from said first bracket part in response to exposure to an elevated temperature, whereby said second bracket part can rotate downwardly about a pivot axis to ensure that the second bracket part will swing out of the way of the panel and allow the panel to fall freely when the heat releasable bracket is exposed to an elevated temperature.

31. The bracket of claim 30, wherein said first bracket part includes a mounting portion for attachment thereof to a support structure.

32. The bracket of claim 31, wherein said mounting portion comprises a vertical flange portion attached at a right angle to a horizontal projecting flange portion, one of said flange portions having a tab adapted to engage a slot provided in the support structure to secure said first bracket thereto.

33. The bracket of claim 32, wherein said first bracket part includes a horizontal projecting flange portion having a downwardly slanting coupling tab, and said second bracket part includes an upwardly slanting coupling tab, said downwardly and upwardly slanting coupling tabs being adjacent to and in plane alignment with each other when said bracket is assembled, said tabs being joined together through said heat releasable link.

34. The bracket of claim 33, wherein said second bracket part is a member which includes a flange plate having a top surface which abuts the underside of said horizontally projecting flange portion of said first bracket part, and having an opening through which said downwardly slanting tab passes;

a lower horizontal flange having an upper surface for supportingly engaging the panel; and a vertical step connecting said flange plate and said flange of said second bracket part.

35. The bracket of claim 34, wherein said second bracket part includes a flap which extends downwardly from the end of said flange plate nearest said mounting portion of said first bracket part, said flap having a swing tab which projects outwardly away from said flange plate, said swing tab being received in a rectangular slot in the vertical flange portion of said first bracket part to allow said second bracket part to swing downwardly about a pivot axis approximately coincident with said slot when said heat releasable link is exposed to an elevated temperature which allows said second bracket part to be released from said first bracket part.

* * * * *